United States Patent [19]

Bucher

[11] Patent Number: 4,815,971

[45] Date of Patent: Mar. 28, 1989

[54] MULTI-TIER LOAD FIXTURE FOR A TOP-LOADING FURNACE FURNACE

[75] Inventor: George D. Bucher, Columbia, S.C.

[73] Assignee: Westinghouse Electric Corp., Pittsburgh, Pa.

[21] Appl. No.: 126,986

[22] Filed: Nov. 27, 1987

[51] Int. Cl.[4] ..... F27B 21/04

[52] U.S. Cl. ..... 432/239; 432/253; 432/261; 432/45

[58] Field of Search ..... 432/261, 239, 253, 24, 432/45, 120

[56] References Cited

U.S. PATENT DOCUMENTS

| | | | |
|---|---|---|---|
| 624,005 | 5/1899 | Forbes . | |
| 2,300,783 | 11/1942 | Grubel et al. | 432/261 |
| 3,461,190 | 8/1969 | Kemeny et al. | 432/24 |
| 3,642,263 | 2/1972 | Pine et al. . | |
| 3,741,718 | 6/1973 | Boyer et al. | 432/261 |
| 4,272,306 | 6/1981 | Reisinger, Jr. . | |
| 4,349,109 | 9/1982 | Scordato et al. . | |

FOREIGN PATENT DOCUMENTS 753001 7/1956 United Kingdom .

*Primary Examiner*—Henry C. Yuen

[57] ABSTRACT

A self-aligning fixture for use in a high temperature top-loading furnance includes multiple stacked trays to optimize load placement and capacity and to minimize fixture heat absorption. The fixture is manipulated by a handling tool to insert, position, and withdraw the fixture without obscuring the chamber and includes self-aligning blackbody radiators insertable by a handling tool into the optical path of an optical pyrometer and onto a selected tray for temperature monitoring of the load therein. A calibration blackbody radiator allows independent pyrometer verification of an inserted thermocouple.

7 Claims, 4 Drawing Sheets

MULTI-TIER LOAD FIXTURE FOR A TOP-LOADING FURNACE FURNACE

BACKGROUND OF THE INVENTION

1. Field of the Invention

The invention relates in general to load fixtures for industrial furnaces, and more specifically to load fixtures having a multi-tier assembly that is insertable into a top-loading furnace.

2. Description of the Prior Art

Top-loading high-temperature furnaces are used in industrial applications for the heat treatment and the sintering of small articles. These furnaces are typically useful in a research and development laboratory, a quality assurance station, or production line. The articles to be treated are often a group of small objects or work pieces and thus are collectively known as a load. These furnaces are equipped to subject a load to a temperature in the range of 1700 degrees centigrade and to a sealed gaseous or evacuated environment. The furnace chamber, wherein the load is placed, is completely enclosed and usually accessable only by a hinged or removable door at the top of the furnace.

In such furnaces as described above a tray or a basket is sometimes used as a stable platform for placing a load within the chamber. However, a more versatile fixture is required that can accommodate a variety of large and small loads and that can subject the load articles to effective heat treatment regardless of their number or size. The relative positions of articles will affect the heat treatment they receive; moreover, a small load mass relative to a large fixture mass will also degrade the heat treatment. Therefore, a need exists for a fixture that is large enough to carry a maximum load yet is adaptable to a small load.

Further, there exists a need to ascertain the temperatures of various levels within the furnace chamber while it is in operation, and to monitor the temperature of the radial thermocouple that is traditionally used for feedback control of the furnace heating elements. More specifically, it is necessary to obtain independent optical pyrometer measurements of the ambient temperature in the vicinity of the load while the furnace is closed and operating. Typical top-loading furnaces include a viewport in the center of the access door. Because the aperture of the optical path into the chamber is quite small (typically 0.76 centimeters in diameter), any object monitored by a pyrometer must be accurately aligned with the optical path.

The placement of a load in the chamber is difficult. In the prior art, a load is typically lowered by hand onto a hearth plate or, alternatively, the load is distributed upon a basket or tray which is inserted by hand into the furnace. A typical top-loading furnace chamber is tall and narrow with its top opening is being about 15 centimeters in diameter. Thus, when the furnace is loaded, the user's hand obscures all view of the load, the carrier when used, and the interior of the chamber. Normally, considerable trial and error is required involving the repeated opening and closing of the furnace and repositioning of the load, before adequate alignment is achieved.

SUMMARY OF THE INVENTION

The present invention comprises a load fixture for inserting, positioning, and withdrawing articles in a top-loading furnace. The fixture includes a plurality of stacked, concentric trays, each tray having a central bore. A plurality of supporting legs for each tray are attached to an underside thereof, and each tray is held in superposition by the supporting legs which in turn are supported by and separable from the immediately subadjacent tray. A base, having a central positioning hole is adapted to receive the hearth plate pilot in alignment therewith. The lowermost one of the trays is supported by a plurality of said legs fixed to and supported by the base. A plurality of blackbody radiators each being sized to be located selectably in the central bore of a selected one of said plurality of stacked trays emits energy corresponding to the temperature of the corresponding tray into which said blackbody radiator is located.

The multiple stacked trays may be increased or decreased in number to accommodate varying article size and load capacity and to minimize fixture mass and thus fixture heat absorbtion. Adjustment of the fixture capacity also minimizes the shielding of the load from radiant heat emitted by furnace heating elements. The load is therefore more evenly and consistently heated. The fixture is aligned with a viewing port on the central axis of the furnace chamber by means of a positioning pilot.

The invention further includes a handling tool for raising, lowering, and positioning the fixture, and a similar insertion tool for placement of the blackbody radiator in the fixture. The handling tool and the insertion tool permits a rapid change-out of the load to and from the furnace. The throughput of treated loads is increased, the cycle time between heat treatments is reduced, and the accuracy of temperature measurements and thermocouple data is increased.

BRIEF DESCRIPTION OF THE DRAWINGS

The invention may be better understood, and further advantages and uses thereof are readily apparent, when considered in view of the following detailed description of exemplary embodiments, taken with the accompanying drawing in which.

DESCRIPTION OF THE PREFERRED EMBODIMENTS

Figure 1:
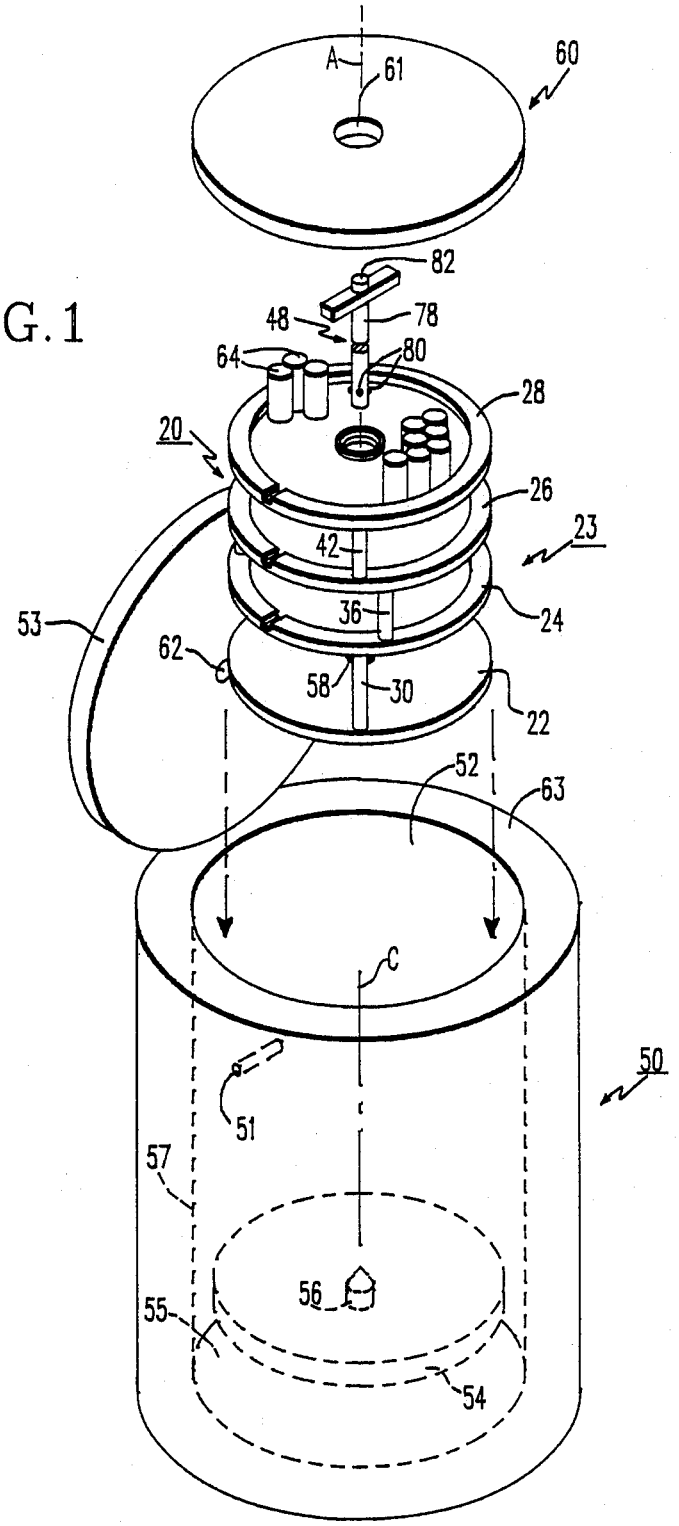
FIG. 1 is an exploded perspective view of a multi-tier load fixture, a fixture handling tool, and a hearth plate according to an embodiment of the present invention for use with a top loading furnace.
Figure 2:
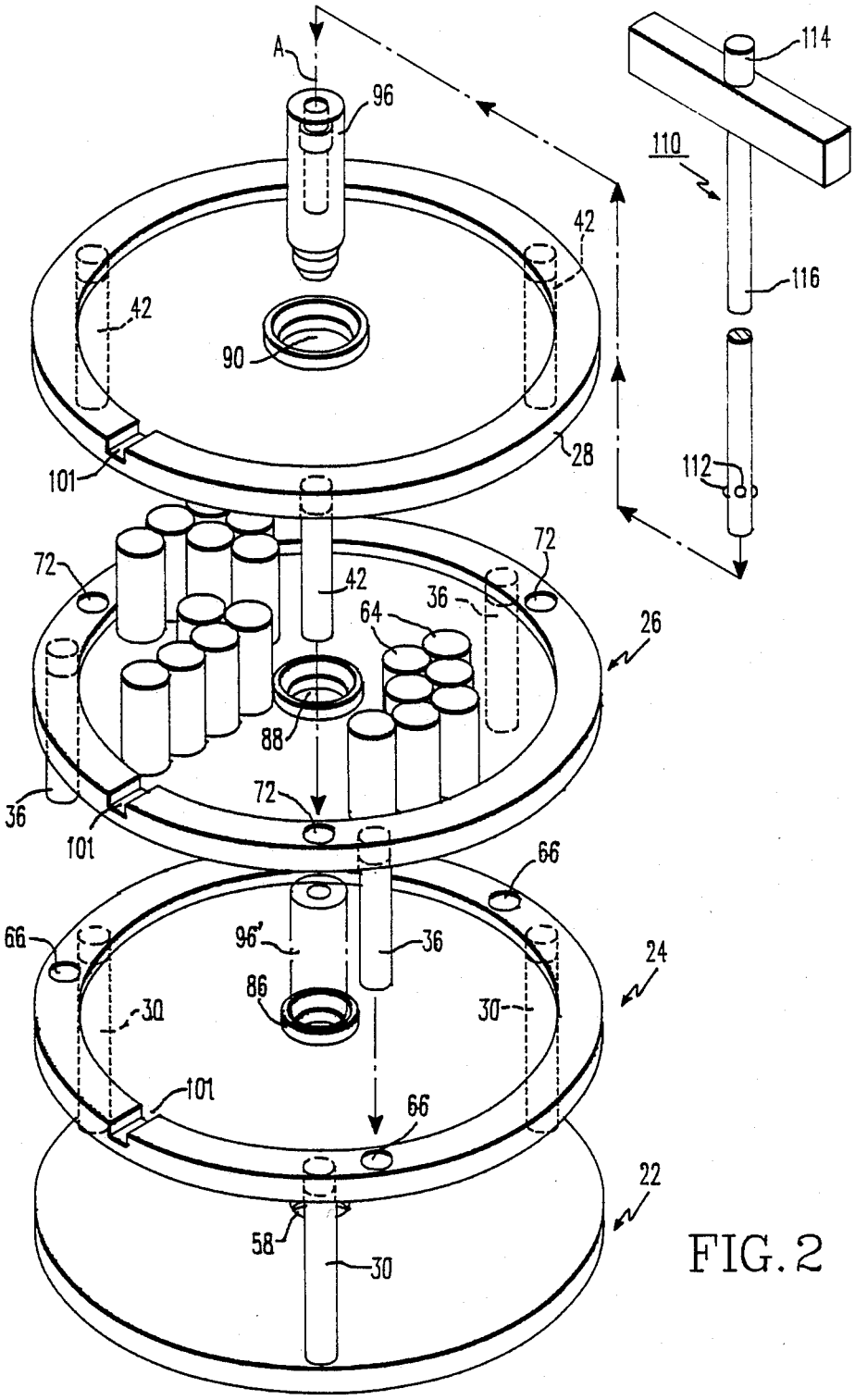
FIG. 2 is an exploded perspective view of the multi-tier load fixture shown in FIG. 1.
Figure 3:
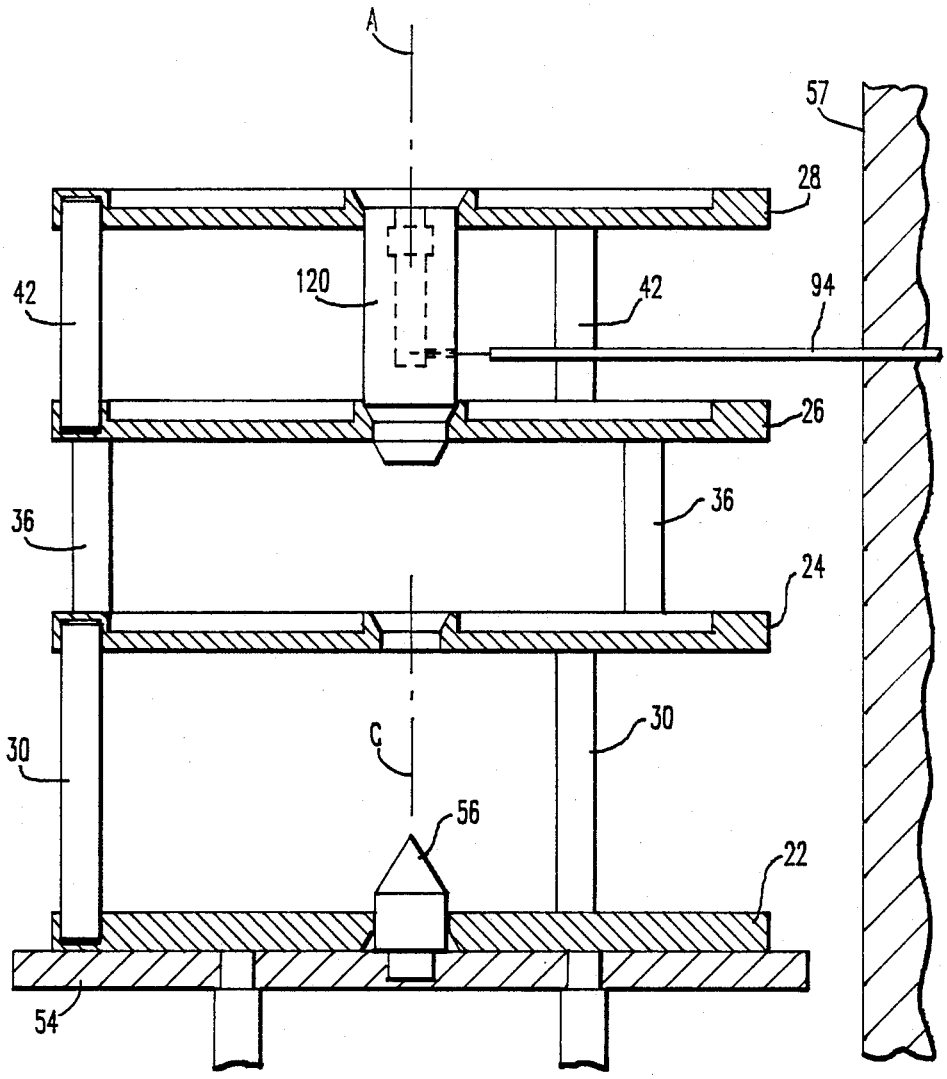
FIG. 3 is a side sectional view of the multi-tier load fixture of FIG. 2 shown schematically in spaced relation with a thermocouple and a fragmentary portion of the furnace wall.
Figure 4A:
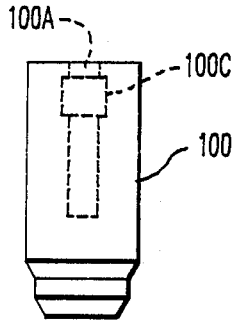
FIGS. 4A–4D are side elevation views of blackbody radiators according to various embodiments of the present invention.
Figure 4B:
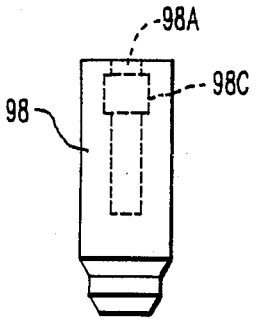
Figure 4C:
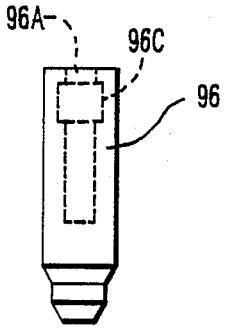
Figure 4D:
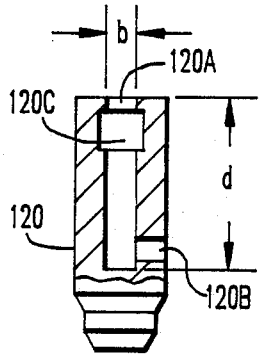

FIGS. 1, 2, and 3 illustrate a multi-tier load fixture 20 which is constructed in accordance with the principles of the present invention. FIGS. 1 and 3 also illustrate portions of a high temperature furnace 50 into which the load fixture 20 is placed.

The load fixture 20 according to an embodiment of the present invention includes a base 22 and a plurality of trays 23. In the embodiment illustrated in FIGS. 1–3 there is provided a bottom tray 24, a middle tray 26, and a top tray 28. The trays 23 are stacked in a superadjacent supporting relationship coaxial with a central tray axis A. The bottom tray 24 is supported on depending legs 30 and is attached by said depending legs 30 to the base 22. The middle tray 26 is supported by depending legs 36 and rests atop bottom tray 24. The top tray 28 is supported by depending legs 42 and rests atop middle tray 26.

A fixture handling tool 48 may be used to place the fixture 20 into chamber 52 of the high-temperature furnace 50. The furnace 50 is formed of a bottom wall 55, an upstanding peripheral sidewall 57 and an apertured cover 53 having a viewing port 62 therein. The furnace 50 has a cylindrical interior chamber 52 having a central axis C. Heating elements (not shown) are provided for in the furnace. The chamber 52 is accessable by opening the furnace door 53. A hearth plate 54 with central pilot 56 aligned with the central axis C of the chamber 52 rests upon the bottom wall 55 or floor of the chamber 52. The base 22 has a central bore 58 which engages the pilot 56 for aligning the base 22 within the furnace chamber 52 and the furnace axis C is coaxial with tray axis A when the fixture 20 is placed therein. After the fixture 20 is lowered into the chamber 52 and onto the hearth plate 54, the pin apparatus 80 is released from the fixture 52 as hereinafter described and the handling tool 48 is withdrawn. A top shield 60 having a central viewport 61 is placed on a upper surface 63 of the furnace sidewall 57. When the furnace door 53 is closed, the door viewport 62 and the shield viewport 61 are coaxially aligned with furnace axis C. After the furnace door 53 is closed, the furnace 50 may be activated. Temperature conditions in the chamber 52 may thus be monitored through the shield viewport 61 and the door viewport 62.

The load consists of pellets 64 which may be placed on any of the trays 24, 26, or 28. However, the capacity of the fixture 20 is adaptable to the load by the successive addition or removal of the middle tray 26 and the top tray 28 from the bottom tray 24 according to the needs of the user. The present invention facilitates the careful positioning of a load by the use of a handling tool 48 to manipulate the fixture 20. The tool 48 on its shaft 78 includes a retractable pin apparatus 80 which retracts by finger pressure on a button 82. After retraction of the pin apparatus 80, the tool shaft 78 is inserted through central annular bores 90, 88, and 86 of the top tray 28, middle tray 26, and bottom tray 24, respectively, until the pin apparatus 80 may be released at a position below the underside of the bottom tray 24. The user lifts the tool 48 and the pin aparatus 80 is made to support the bottom tray 24. The bottom tray 24 lifts the attached base plate 22 by legs 30 and supports the middle and upper trays 26 and 28 (if present); thus, the entire fixture 20 may be manipulated by the use of the handling tool 48. Hence, after the fixture 20 is loaded with pellets 64, the tool 48 is used to lower the fixture 20 into the furnace chamber 52 and onto the hearth plate central pilot 56 as may be seen in FIG. 3. Retraction of the pins 80 allows the tool 48 to be withdrawn from the chamber 52. The fixture 20 thereby remains centered upon the central pilot 56 and thus is aligned to the furnace axis C. As shown in FIG. 3, the top tray legs 42 fit freely into middle tray holes 72 and the middle tray legs 36 fit freely into bottom tray holes 66. Thus, the stability of the trays 23 is assured by the supporting hearth plate 54 and depending legs 30, 36, and 42. Moreover, the circumferential edge of each tray 24, 26, and 28 is slightly raised, as are the central annular bores 86, 88, and 90, so as to contain the pellets 64.

With reference to FIGS. 1 and 3, it may be seen that after placement of the fixture 20 into the chamber 52, a radial thermocouple 94 (FIG. 1) may be inserted through an opening 51 (FIG. 1) in the furnace wall so as to monitor the ambient temperature of the chamber 52. As shown in FIG. 2, the trays 23 are identifiably indexed by notches 101 to provide instant recognition of the tray orientation when viewed from above. The notches 101 further remind the user to provide a radial path free of pellets 64 for the insertion of the radial thermocouple 94.

For many heat-treatment applications, it is necessary to obtain optical pyrometer temperature measurements at various levels of the load concentration so as to verify the radial thermocouple data. To this end, one of the blackbody radiators 96, 98, and 100, as shown in FIG. 4, may be placed in a selected one of the central annular bores 86, 88, and 90, respectively, at the center of load distribution and may be optically monitored through the viewports 61 and 62 by an optical pyrometer (not shown). Each of the blackbody radiators 96, 98, and 100 have a central inner bore **96*a*, 98*a*, and 100*a* and recess 96*c*, 98*c*, and 100*c*, respecitvely. A calibration blackbody 120 is provided which is identical to the middle tray blackbody radiator 98 and includes inner bore 120*a* and recess 120*c* but further includes a lateral bore 120*b***.

Each blackbody radiator is sized to rest upon the central annular bore of its respective tray. The bottom tray central annular bore 86 has a chamfered inner edge which supports the tapered segment of the bottom tray blackbody radiator 96. The middle tray blackbody radiator 98 or the calibration blackbody radiator 120 similarly rest upon the middle tray central annular bore 88, as does the upper tray blackbody radiator 100 rest upon the upper tray central annular bore 90. The tray bore diameters and respective blackbody radiator diameters become successively smaller from top to bottom such that, for example, the bottom tray blackbody radiator 96 en route to the bottom tray 24 will pass through the middle and upper tray central annular bores 88 and 90. To improve vertical alignment, when either of the lower tray or middle tray blackbody radiators 96 or 98 is seated in its respective tray, its upper major diameter fits into the bore of the above tray.

By positioning a blackbody radiator on the furnace axis C which corresponds to the optical axis for the viewports 61 and 62, an optical pyrometer (not shown) may be used to read the temperature of the blackbody inner bore. The blackbody radiators are designed with a bore (b) to depth (d) ratio of b:d=1:5 (FIG. **4*d*) to optimize the radiator's performance as a blackbody source. Also, each of the blackbody inner bores 96*a*, 98*a*, 100*a*, and 120*a* have a depth such that the reference surface level for pyrometer measurement is located at the approximate midpoint of the height of the pellets 64**. The optical pyrometer (not shown) therefore measures the temperature at the midpoint of pellet height.

Insertion of a blackbody radiator is accomplished after the fixture 20 is positioned in the chamber 52 but before the furnace door 53 is closed. For illustration, the insertion of the bottom tray blackbody radiator 96 will be described, but the process applies to each of the radiators 96, 98, 100, and 120. An insertion tool 110, similar to the handling tool 48, includes a pin apparatus 112 which is retractable by pressure on a button 114. With the pin apparatus 112 retracted, the shaft 116 is inserted into the bore 96a of the blackbody radiator 96. The button 114 is released and thereby the pin apparatus 112 engages the recess 96c in the blackbody radiator inner bore 96a. The blackbody radiator may then be lifted and inserted through the central annular bores 90 and 88 until it rests upon the chamfered edge of its corresponding lower tray central annular bore 86. Upon retraction of the pin apparatus 112, the tool 110 is withdrawn from the inner bore 96a and the central annular bores 90 and 88. A reversal of this sequence is followed to remove the blackbody radiator 96.

The calibration blackbody radiator 120 is provided for placement in the middle tray central annular bore 88. By virtue of the lateral bore 120b in the side of the calibration blackbody radiator 120, the junction tip of the radial thermocouple 94 may be guided through the lateral bore 120b and into the inner bore 120a of the calibration blackbody radiator 120. The junction tip is thereby positioned in the field of view along the optical axis of the pyrometer, and the data from the radial thermocouple 94 may be compared and verified with the optical pyrometer data.

While the invention has been described in connection with specific embodiments thereof, it will be understood that it is capable of further modifications. The claims are intended to cover any variations, uses or adaptations of the invention following, in general, the principles of the invention, and including such departures from the present disclosure as come within known and customary practice within the art to which the invention pertains.

I claim as my invention:

1. A multi-tier load fixture for supporting a plurality of load objects within a top-loading furnace, said furnace having a hearth plate and a central pilot on said hearth plate, comprising:

a base having a central positioning hole adapted to receive the central pilot for self-alignment thereto and having a plurality of circumferentially-spaced upwardly-facing apertures;

at least one tray being in vertically-stacked concentric relation with the base, each tray including a central annular bore of selected diameter, each central annular bore being of a size larger in diameter than a subadjacent central annular bore, a raised circumferential edge with an upper and a lower surface, a radial index notch on the raised circumferential edge, a plurality of circumferentially-spaced upwardly-facing leg receiving apertures located on the upper surface of the raised circumferential edge, a plurality of circumferentially-spaced downwardly-facing leg receiving apertures located on the lower surface of the raised circumferential edge and offset circumferentially from the upwardly-facing apertures, a plurality of depending legs, each having one end press-fitted into one of said downwardly-facing apertures and the other end fitting freely into the opposing upwardly-facing leg receiving aperture of the subadjacent tray, and wherein each of the downwardly-facing leg receiving apertures of the bottom-most tray receives one end of depending leg which at its other end is secured in the opposing one of said upwardly-facing apertures of the base; and at least one blackbody radiator being sized to fit into and rest upon the central annular bore of at least one of the trays and having a central axial bore and recess therein, said blackbody radiator providing energy output indicative of the temperature of the adjacent load objects;

a handling tool including a shaft adapted to pass through the central annular bore of each tray, and having at least one or more retractable pins adapted to engage the bottom surface of the bottom tray in support thereof; and an insertion tool including a shaft adapted to pass through the central bores of each blackbody radiator, and at least one retractable pin being adapted to engage the recess in the blackbody radiator upon insertion therein.

2. A multi-tier load fixture for supporting a plurality of load objects within a top-loading furnace, said furnace having a hearth plate and a central pilot on said hearth plate, comprising:

a tray assembly for containing a load, having a plurality of stacked, concentric trays, each tray having a central bore, a plurality of supporting legs for each tray attached to an underside thereof, each tray being held in superposition by the supporting legs which in turn are supported by and separable from the immediately subadjacent tray, a base having a central positioning hole adapted to receive a hearth plate pilot in alignment thereto, the lowermost one of the trays being supported by a plurality of legs fixed to and supported by the base; and a plurality of blackbody radiators each being sized to be located selectably in the central bore of a selected one of said plurality of stacked trays.

3. A multi-tier load fixture for supporting a plurality of load objects within a top-loading furnace as claimed in claim 2 further comprising means for deposit, positioning, and removal of the tray assembly in the furnace.

4. A multi-tier load fixture for supporting a plurality of load objects within a top-loading furnace as claimed in claim 3 further comprising means for deposit and removal of one of said blackbody radiators.

5. A multi-tier load fixture for supporting a plurality of load objects within a top-loading furnace as claimed in claim 4 wherein one of said blackbody radiators is adapted to receive a thermocouple for calibration thereof.

6. A multi-tier load fixture for supporting a plurality of load objects within a top-loading furnace, said furnace having a hearth plate and a central pilot on said hearth plate, comprising:

a tray assembly including a plurality of trays being vertically stacked in concentric disposition, each tray having a central annular bore of predetermined inner diameter, said diameter being less than the predetermined inner diameter of the superadjacent central annular bore, each tray having a raised circumferential edge, a plurality of circumferentially-spaced legs attached to an underside of each tray, each tray being supported at its circumferential edge by said plurality of legs, said legs being in turn supported by and removable from the circumferential edge of an immediately subadjacent tray, the lowest tray being supported by a plurality of legs attached to and supported by a base, said base having a bottom and having a central bore adapted to receive in alignment the central pilot, a plurality of blackbody radiators for optical pyrometer measurement of load temperature each having a concentric axial bore of a predetermined depth, a recess on the concentric axial bore, a tapered lower segment of predetermined average diameter conforming to the inner diameter of the central annular bore of selected ones of trays so as to rest thereupon, a cylindrical upper segment of predetermined diameter being adapted to rest in the central annular bore of the superadjacent tray;

a handling tool having a shaft insertable through the central annular bores of the tray assembly, said shaft having retractable pins for engaging the bottom of the base for support of the fixture; and an insertion tool having a shaft insertable through the central annular bores of the tray assembly and a plurality of retractable pins adapted to engage the recess so as to support and insert the blackbody into the central annular bore of a selected one of the plurality of trays.

7. A multi-tier load fixture for supporting a plurality of load objects within a top-loading furnace, said furnace having a hearth plate and a central pilot on said hearth plate, comprising:

a tray assembly including a base, wherein the base having a central positioning hole adapted to receive the central pilot of the furnace hearth plate for positionable alignment thereof, and a plurality of trays in stacked, concentric disposition, wherein each tray having a raised circumferential edge, a radial index notch therein, a plurality of depending legs, a central annular bore with a predetermined inner diameter and a chamfer, wherein said tray, raised circumferential edge, and annular central bore being adapted to containing a load placed on the tray;

a bottom blackbody radiator;

a middle blackbody radiator;

a top blackbody radiator;

a calibration blackbody radiator, wherein each bottom, middle, tip, and calibration blackbody radiator being adapted to optical pyrometer measurement of load temperature, and each having a tapered lower segment having a predetermined average diameter, a cylindrical upper segment having a predetermined diameter, a concentric bore having a bore wall, a bore bottom at a predetermined depth, and a recess at the bore wall, wherein each of said average diameters of the bottom, middle, top, and calibration blackbody radiators conforms respectively to each of the inner diameters of the bottom, middle, top, and middle tray central annular bores for placement thereupon, and said bottom blackbody radiator cylinder diameter and said middle and calibration blackbody radiator cylinder diameters each being adapted respectively to the inner diameters of said middle tray and top tray central bores in rest thereupon, and said calibration blackbody having a lateral bore for receiving a thermocouple insertable therein;

a handling tool having a shaft adapted to pass through the bottom, middle, and top tray central annular bores, and at least one retractable pin adapted to engage the bottom surface of the bottom tray in support thereof; and an insertion tool having a shaft adapted to pass through the bottom, middle, and top tray central annular bores, and at least one retractable pin being adapted to engage the recess of the bottom, middle, top, or calibration blackbody radiator inner bore upon insertion therein.

* * * * *